US005574488A

United States Patent [19]

Tamura

[11] Patent Number: 5,574,488

[45] Date of Patent: Nov. 12, 1996

[54] LIQUID JET HEAD, LIQUID JET HEAD CARTRIDGE, AND LIQUID JET APPARATUS

[75] Inventor: Yasuyuki Tamura, Yokohama, Japan

[73] Assignee: Canon Kabushiki Kaisha, Tokyo, Japan

[21] Appl. No.: 361,181

[22] Filed: Dec. 21, 1994

[30] Foreign Application Priority Data

Dec. 22, 1993 [JP] Japan ..... 5-324963

[51] Int. Cl.[6] ..... B41J 2/05; B41J 2/135

[52] U.S. Cl. ..... 347/63; 347/47; 347/63; 347/71

[58] Field of Search ..... 347/63, 65, 20, 347/47

[56] References Cited

U.S. PATENT DOCUMENTS

| | | | |
|---|---|---|---|
| 4,460,906 | 7/1984 | Kanayama | 347/71 |
| 4,599,628 | 7/1986 | Doring | 347/71 X |
| 4,633,274 | 12/1986 | Matsuda | 347/86 X |
| 5,095,321 | 3/1992 | Saito | 347/20 X |

FOREIGN PATENT DOCUMENTS

| | | | |
|---|---|---|---|
| 61-166841 | 10/1986 | Japan | B41J 3/04 |
| 2-26677 | 7/1990 | Japan | B41J 2/05 |
| 2-192954 | 7/1990 | Japan | B41J 2/175 |
| 3-10046 | 3/1991 | Japan | B41J 2/05 |

*Primary Examiner*—Joseph W. Hartary
*Attorney, Agent, or Firm*—Fitzpatrick, Cella, Harper & Scinto

[57] ABSTRACT

A liquid jet head for recording by discharging a liquid from discharge ports comprises an elemental base board having on it elements for generating discharge energy to discharge a liquid, and a head having a discharge port member with a plurality of the discharge ports arranged therefor, which constitutes a plurality of liquid passages by being pressed to be in close contact with the surface of the elemental base board on the side where the elements for generating discharge energy are arranged. This discharge port member is provided with an extension which is extendedly present to the reverse side of the aforesaid surface, and also, provided with biasing means for pressing the discharge port member to be in close contact with the aforesaid surface by exerting a biasing force on the extension.

19 Claims, 10 Drawing Sheets

LIQUID JET HEAD, LIQUID JET HEAD CARTRIDGE, AND LIQUID JET APPARATUS

BACKGROUND OF THE INVENTION

1. Field of the Invention

This invention relates to a liquid jet head, a liquid jet head cartridge, and a liquid jet apparatus. More particularly, the invention relates to a liquid jet head formed by joining a discharge port member with an elemental base board having the elements on it for generating discharge energy for discharging liquid, a liquid jet head cartridge and a liquid jet apparatus which use such liquid jet head.

2. Related Background Art

As an ink jet recording head, there have hitherto been used, among others, a head which adopts piezoelectric elements as those generating discharge energy to creation pressure changes in the ink passages for discharging ink droplets by the utilization of the distortion of the piezoelectric elements, and a head which uses heat generating elements arranged in ink passages to create air bubbles by heating ink rapidly for discharging ink droplets. Of these heads, the so-called bubble jet recording head, wherein ink is discharged by heating it rapidly by use of the elements for generating heat, can be structured simply to make it possible to arrange many numbers of nozzles in a high density. Advantageously, therefore, this method enables a high speed recording in a high precision.

As a method of manufacturing the bubble jet recording head having many nozzles integrally formed in it, a heater board is prepared by arranging a thinly filmed heater and its wiring on the surface of a plate made of silicon or the like, and using it as the base board, a dry film is bonded on it. Then, after exposure and development, a ceiling board made of glass or the like is joined to it, and the discharge port unit is produced by cutting the integrated body thus fabricated. Also, there is, among others, a method in which the nozzle pattern is formed on the base board by use of a photosensitive resin. After covering it with resin, the integrated body thus prepared is cut to form the discharge port unit, and then, the photosensitive resin is removed for the formation of a head. Further, a method is adopted to make a discharge port member, in which grooved nozzles and discharge ports are formed by resin, and then, to press this member to be in contact with a base board to fabricate a head. It is widely used because the nozzles of a complicated configuration can be fabricated at a lower cost in accordance with this method. The method is remarkably superior and suitably applicable to its production on a large scale. This method is disclosed in the specification of Japanese Laid-Open Patent Application No. 2-192954.

As a structure to supply ink to many numbers of nozzles, methods are known, in which ink is supplied from behind the base board by providing through holes for the base board or in which ink is supplied from the end portion of the base board by arranging grooves for the base board or some others in addition to the method wherein the ink supply paths are arranged for a common liquid chamber formed on a base board together with nozzles. These methods are disclosed in the specifications of Japanese Utility Model Publication No. 3-10046, Japanese Utility Model Publication No. 2-26677, and Japanese Laid-Open Utility Model Application No. 61-166841.

For the method of manufacturing a recording head by preparing the discharge port member having the grooved nozzles formed by resin, and pressing it to be in contact with the base board for the formation of the head, it is important to arrange the discharge port member to be in close contact with the base board reliably. In the specification of Japanese Laid-Open Patent Application No. 2-192954, it is disclosed that the discharge port member is pressed to be in contact with the base board by use of a spring compressing it from the above. This method makes a close contact possible reliably, but it results in limiting the configuration of a recording head because of the required arrangement of a spring and others above the discharge port member.

For example, it is difficult to apply this method to a recording head of a type in which ink is discharged in the surface direction side of the base board. If it should be arranged just to mount the discharge port member having discharge ports and walls between adjacent nozzles on the base board, the pressure exerted between the adjacent nozzles tends to leak, and not only the discharging force is weakened, but also, a hindrance occurs due to cross talks. It is also difficult to bond them by use of adhesives because nozzles are extremely small. If contacting means such as a spring is arranged above the surface of the discharge port member, the quality of recording image is degraded since it is impossible to set the distance between the discharge ports and a recording medium close enough to obtain a recorded image of a good quality.

This invention is designed to solve these problems. It is an object of the invention to provide a liquid jet head for which the discharge port member and the base board can be closely in contact with each other reliably, the head configuration can be flexibly arranged, and the distance between the discharge ports and a recording medium can be set close enough.

SUMMARY OF THE INVENTION

The principal structure of a liquid jet head whereby to achieve the object described above is provided with a head having an elemental base board on which elements for generating discharge energy are arranged to discharge a liquid, and a discharge port member having a plurality of discharge ports, which forms a plurality of liquid passages when it is pressed to be in contact with the surface of the elemental base board on the side where the elements for generating discharge energy are arranged, and then, biasing means provided for the discharge port member having an extension which is extendedly present on the reverse side of the aforesaid surface, the biasing means being arranged to give a biasing force to such an extension in order to press the discharge port member to be in close contact with the aforesaid surface.

Also, the principal structure of a liquid jet head cartridge is provided with the aforesaid liquid jet head, and a liquid container for retaining a liquid to be supplied to the liquid jet head.

Also, the principal structure of a liquid jet recording apparatus is provided with the aforesaid liquid jet head, means for feeding a recording medium or means for supplying driving signals to the recording head for driving it.

As means for pulling the aforesaid extension, a flat spring is used to provide a stable pulling force or a nailing unit is provided for the elastic extensions of the discharge port member to make it possible to bias the discharge port member to the base board side reliably by use of the nail unit thus arranged.

In a recording head of a type in which ink is discharged in the direction substantially orthogonal to the surface of the elemental base board, the aforesaid extension is provided through the ink supply path arranged on the base board, thus making it possible to extend it beyond the reverse side of the elemental base board.

In a recording head of a type in which ink is discharged in the direction substantially parallel to the surface of the elemental base board, the aforesaid extension can be extended to the reverse side of the elemental base board in the end portion of the base board in the ink discharging direction.

For the liquid head, since the discharge port member must be in close contact with the base board reliably, adhesives or the like can be used as required on the areas other than an extremely small area where the walls of nozzles are formed closely to means for generating pressure in order to effectuate the discharge. This is the only area in which a fine structure is arranged, thus making the close contact difficult. Therefore, in accordance with the present invention, means for generating pressure is arranged in a position near the ink supply inlet or the end portion on the base board, while a part of the discharge port member is extended to the reverse side of the base board, and then, pulled into the ink supply path or at the end portion of the base board. In this way, it is made possible to reliably keep even the area where the fine structure is arranged in close contact.

In accordance with the present invention, it is also possible to arrange the discharge port member to be in close contact by use of a simple structure, and even when many nozzles are arranged in a high density, there is no possibility that pressure is caused to leak between the adjacent nozzles. Also, there is no need for executing any difficult work required for applying adhesives or the like to the portions where nozzles and other fine structure are arranged.

BRIEF DESCRIPTION OF THE DRAWINGS

FIG. 6A is a perspective view illustrating the discharge port member having the nails; and FIG. 6B is a perspective view illustrating the state where the base board is mounted on a supporting frame.

DETAILED DESCRIPTION OF THE PREFERRED EMBODIMENTS

Hereinafter, with reference to the accompanying drawings, the detailed description will be made of the present invention according to the embodiments.

Embodiment 1

FIG. 1 to FIG. 5 illustrate an example of the liquid jet head according to the present invention.

The elemental base board which constitutes a liquid jet head embodying the present invention is an elemental base board having on its surface the elements for generating head arranged as elements for generating discharge energy. The head embodying the present invention is arranged to heat ink, or the liquid, rapidly by the application of the generated heat by the aforesaid elements for generating heat, hence creating film boiling to discharge the liquid by the pressure exerted by the air bubbles thus generated.

The discharging direction of ink, or the liquid, is essentially the surface direction of the elemental base board (direction toward the side facing the elemental base board).

Figure 1:
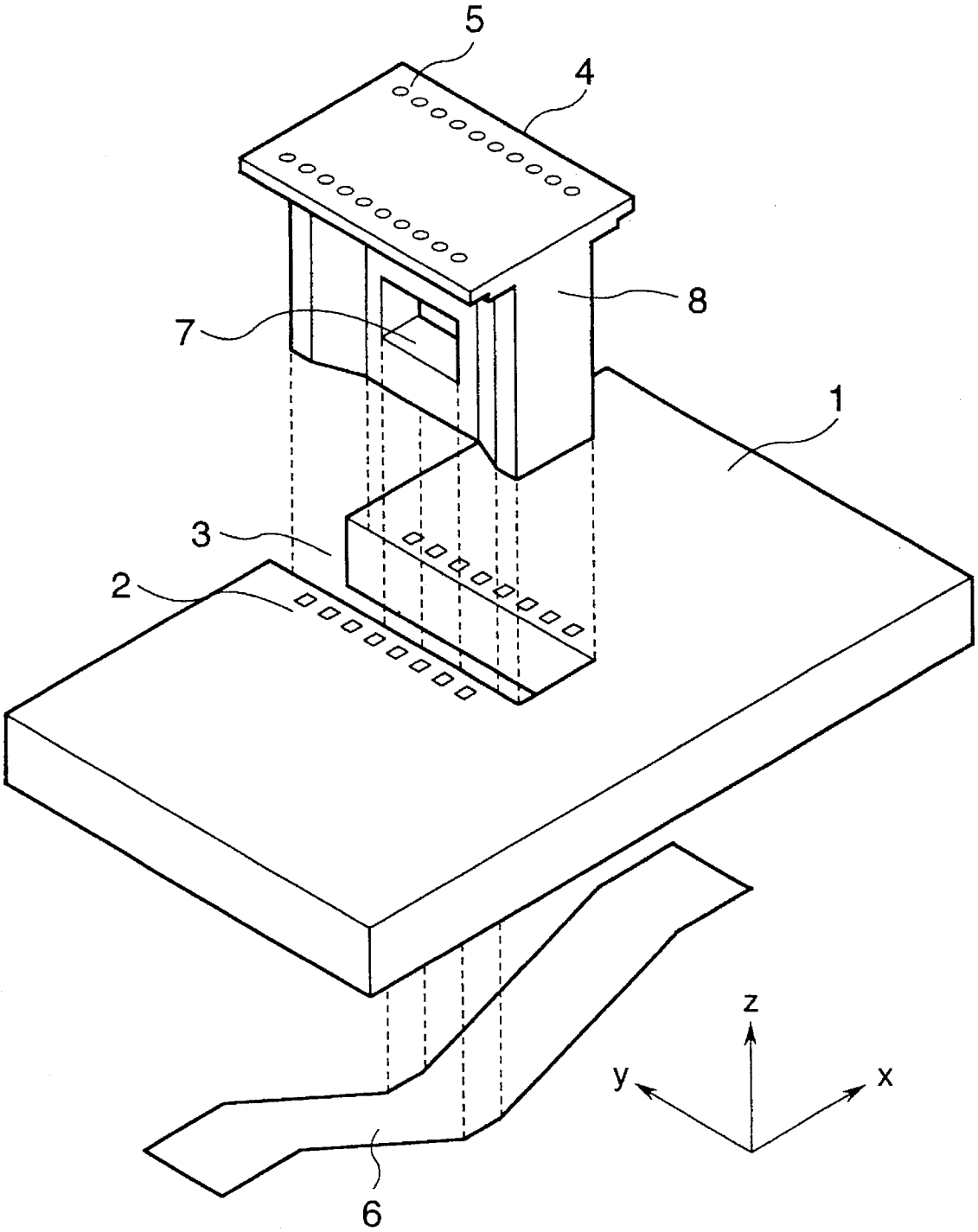
FIG. 1 is a perspective view which illustrates a liquid jet head having the discharge port member and the elemental base board closely in contact according to the present invention.

In FIG. 1, the elemental base board 1 is formed by a silicon wafer. On the surface thereof, there are formed, among others, heat generating elements 2, and the wiring which is arranged to drive the heat generating elements. In addition, shift registers, transistors, and the like are incorporated on the elemental base board for driving the heat generating elements in accordance with signals. After cutting the elemental base board to a given dimension, an ink supply passage 3 is formed thereon by arranging cut (cut off) portion from the side end by use of a dicing saw.

It is also possible to form the ink supply passage by arranging a hole on the elemental base board.

The discharge port member 4 having a plurality of discharge ports 5 is provided with a portion 8 which is extendedly present. Therefore, its configuration is slightly complicated, but using resin its formation is easy. As the resin material, polyethersulfone, polysulfone, polyetheretherketone, or other materials having a good resistance to ink can be used suitably. The discharge port member can be formed by an injection molding. Particularly, however, the discharge ports must be made fine in a high precision. Therefore, it may be possible to form the member without any discharge ports by the injection molding at first. Then, using a laser process, the discharge ports are formed to meet this requirement.

As a method for manufacturing the discharge port member, a method may also be adoptable for forming it with nickel or the like by electroforming, but compared to the method described above, not only it is expensive, but its productivity is inferior. Further, it may be possible to produce only a part of the discharge port member by the electroforming, while forming the other part by use of resin, and then, fabricate this member by adhesively bonding both parts.

The central part of the discharge port member is extendedly present downward to the reverse side of the surface of the elemental base board where the elements for generating discharge energy are arranged so that it penetrates the ink supply passage. A through hole 7 is arranged on such an extended portion to enable a flat spring 6 to pass it.

For the flat spring 6, it is preferable to use phosphore bronze or the like having a good resistance to ink by giving stainless, resin, and corrosion-inhibiting treatments to it.

As another example, it may be possible to form a flat spring by resin together with the discharge port member. In this case, there is no need for any hole for the flat spring to pass.

The principal part of the ink jet recording head is completed by combining the discharge port member, elemental base board, and flat spring. Here, it is preferable to seal the contacting portion of the discharge port member and the elemental base board by use of a sealing agent 12 (FIG. 2 and FIG. 3) so as not to allow ink to leak from the circumference thereof.

Figure 2:
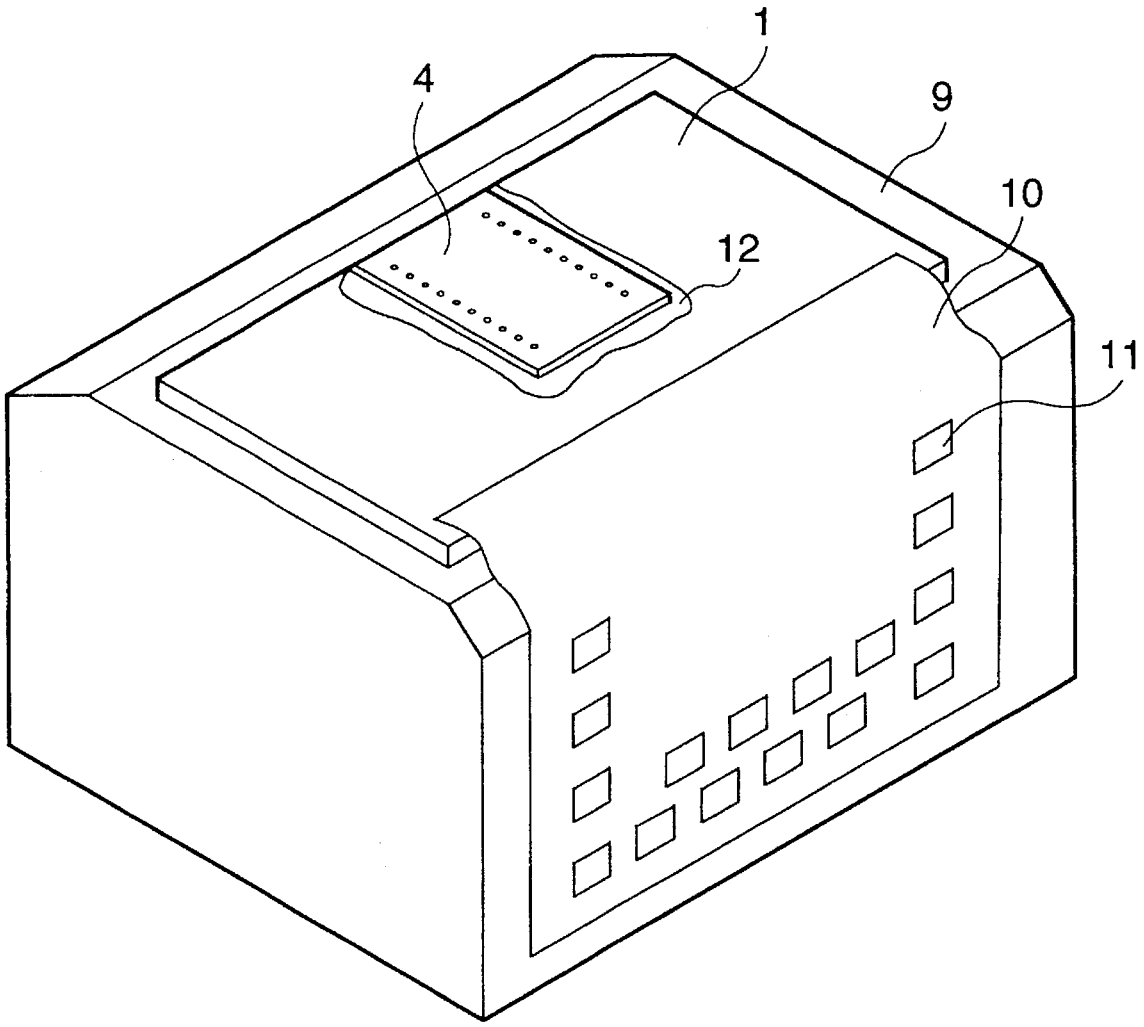
FIG. 2 is a perspective view which illustrates a liquid jet head cartridge having an ink container formed together with the recording head.

With respect to this principal part, mean for supplying ink is mounted to supply ink from behind the elemental base board. Then electrical assembly is made to complete a recording head. In accordance with the present embodiment, the discharge port member has the walls also arranged on it for the formation of liquid passages conductively connected to the discharge ports. However, if the elemental base board is already provided with such walls on it, there is no need of any provision of the walls for the discharge port member. FIG. 2 shows a liquid container (an ink tank) 9 which is formed together with the recording head as means for supplying ink. Also, the electrical assembly is prepared by TAB, and arranged to contact with a printer main body through the contact points 11 of the TAB table 10.

Figure 3:
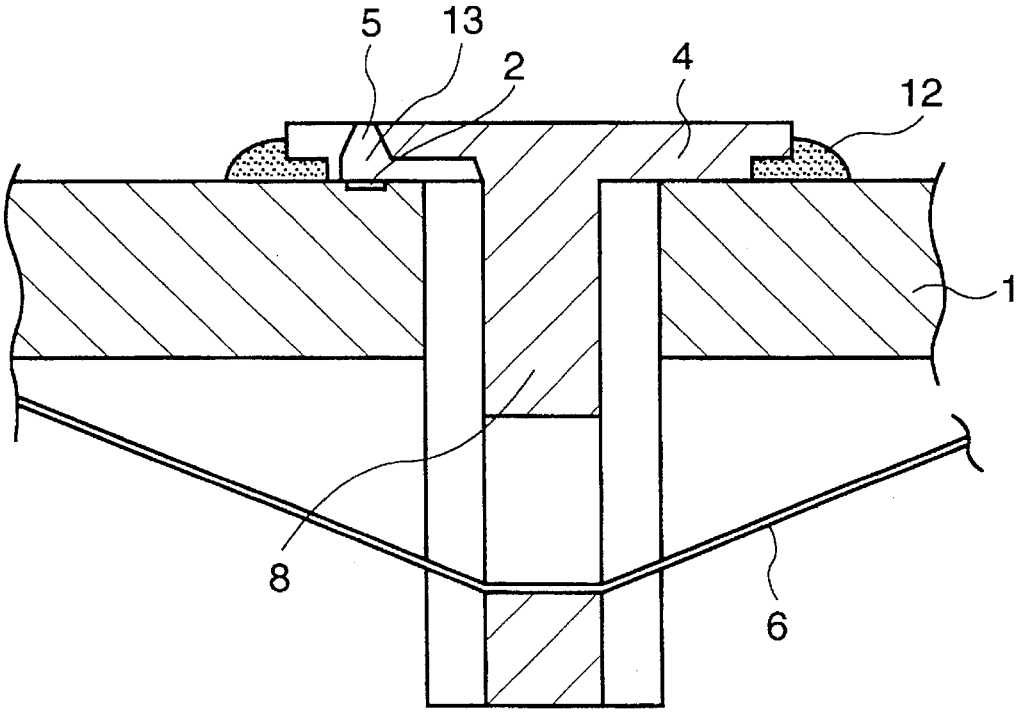
FIG. 3 is a cross-sectional view which illustrates an assembled state of the liquid jet head shown in FIG. 1, taken along the x-z plane.

FIG. 3 is a cross-sectional view which shows a state where the liquid jet head shown in FIG. 1 is assembled. FIG. 3 is a section of the ink jet recording head shown in FIG. 1, taken along the x-y plane. The interval between nozzles 13 of each nozzle alignment on the left and right sides is two times a given recording density. The positions of the nozzle alignments on the left and right sides are displaced by ½ of the nozzle interval. In this way, it is arranged to satisfy a given recording density as a whole. In FIG. 3, the section of a nozzle on the left side is shown. In the position of the nozzle on the right side, a section of the wall portion between nozzles is shown. Also, as clear from FIG. 3, it is noticeable that the flat spring 6, or the biasing means, exerts its biasing force onto the extension 8 of the discharge port member 8, thus enabling the surface of the elemental base board having the elements arranged thereon and the discharge port member to be in close contact under pressure.

Figure 4:
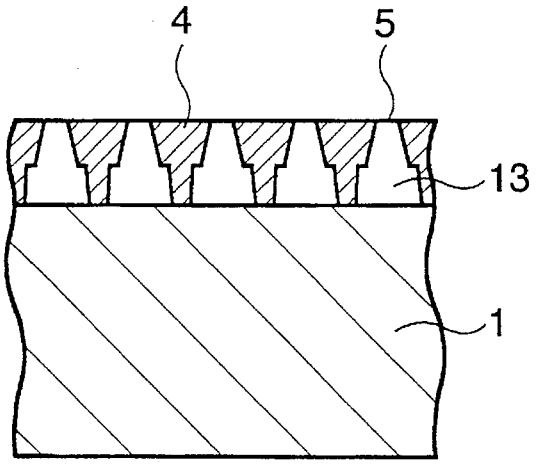
FIG. 4 is a cross-sectional view which illustrates the nozzle portion of the liquid jet head shown in FIG. 1, taken along the y-z plane.

FIG. 4 is a cross-section showing the nozzle portion of the liquid jet head shown in FIG. 1, taken along the y-z plane.

Figure 5:
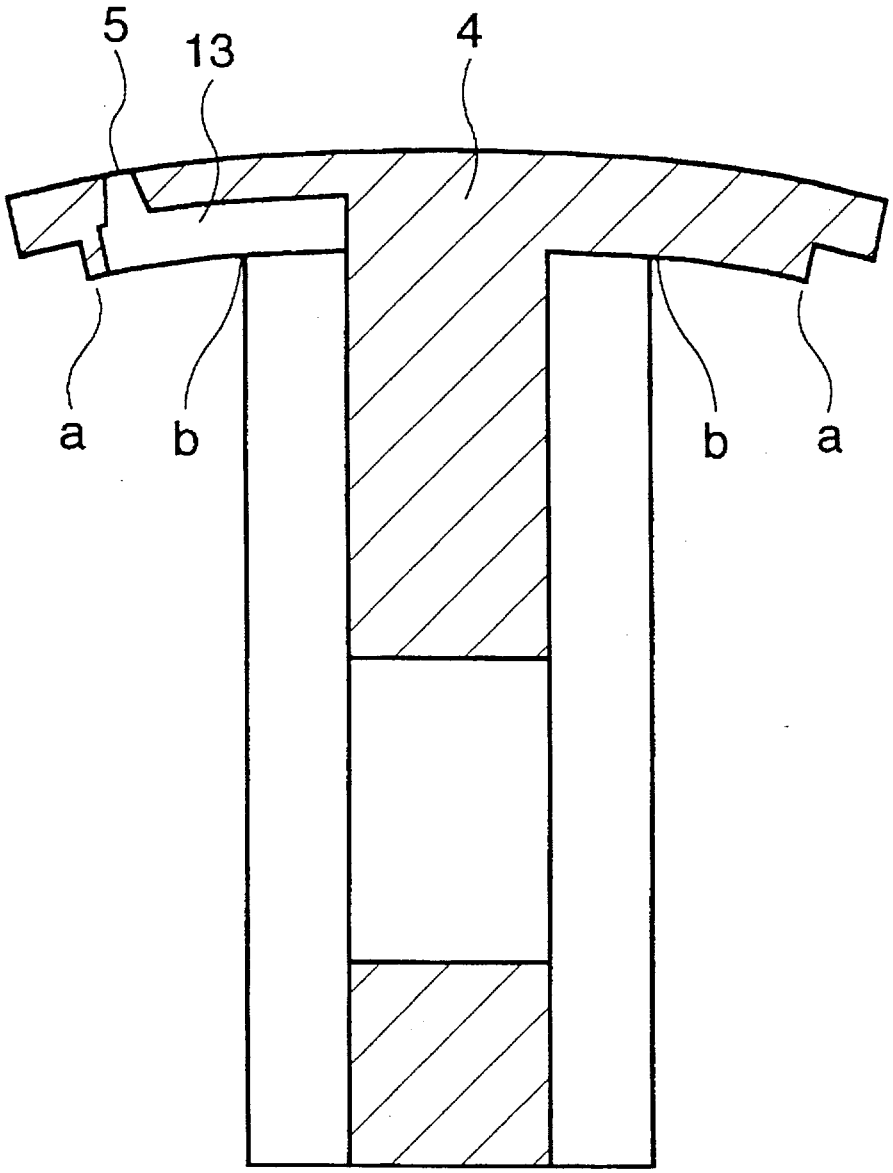
FIG. 5 is a cross-sectional view which illustrates a discharge port member being bent in advance.

In order to closely contact the discharge port member and the base board reliably, it is effective to bend the portion of the discharge port member 4 other than its extension (where liquid paths are formed) in advance as indicated by its section shown in FIG. 5. In this case, when the portion is pulled by the spring, the position at a is in contact at first, and then, further pulled strongly, the position at b is in contact.

When the number of nozzles (discharge ports) is many, and the discharge port member is elongated in the direction y, it may be effective to use a plurality of flat springs or a flat spring of a comb type after arranging a plurality of holes for each flat spring to pass, respectively.

Embodiment 2

Figure 6A:
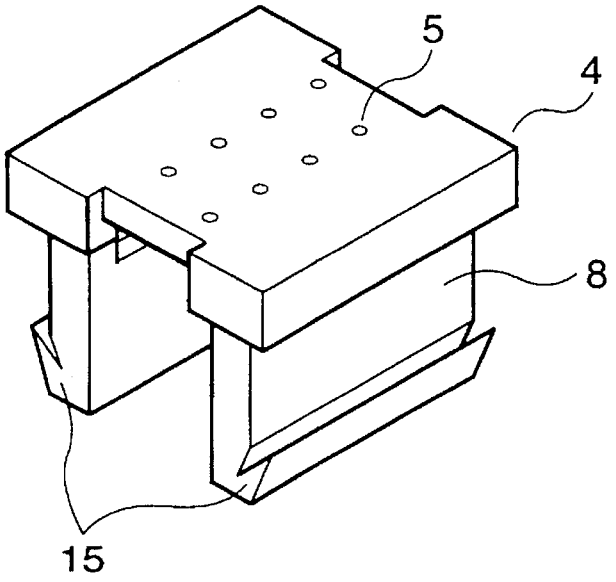
FIGS. 6A and 6B are views which illustrate a liquid jet head having the discharge port member being in close contact with the base board by providing nails for the discharge port member according to the present invention.
Figure 6B:
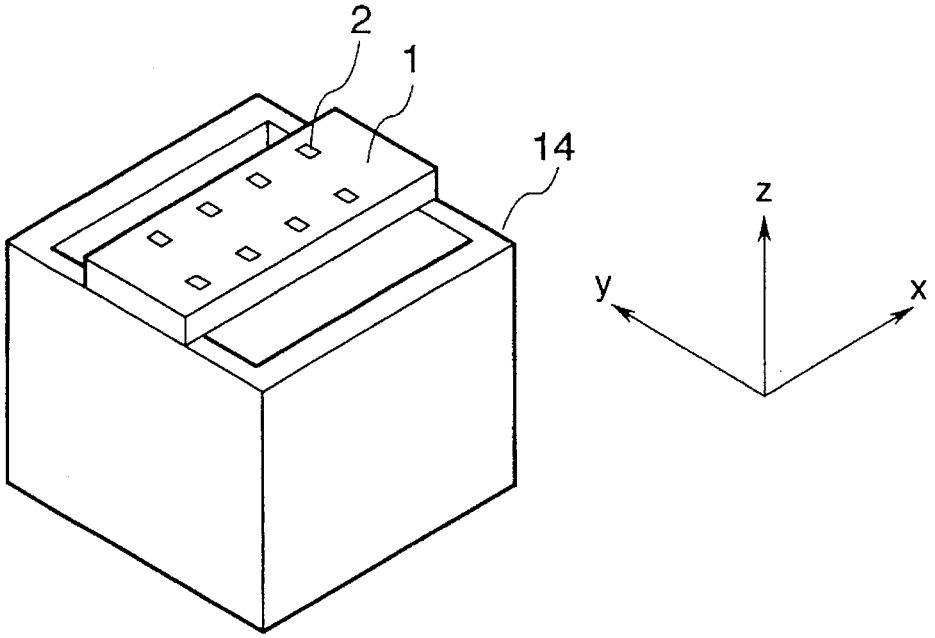
Figure 7:
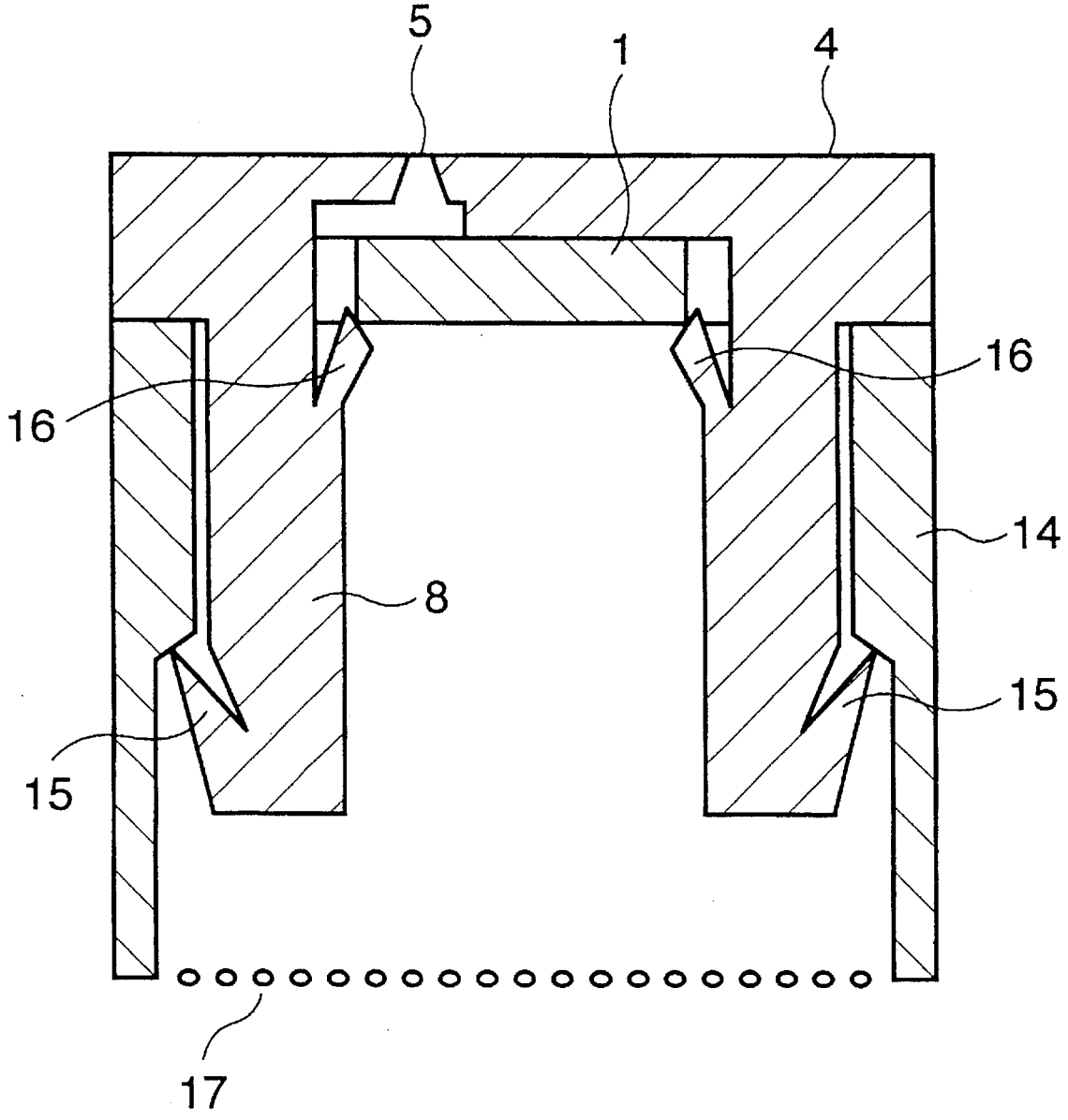
FIG. 7 is a cross-sectional view which illustrates the liquid jet head shown in FIGS. 6A and 6B, taken along the y-z plane with the discharge port member, the substrate and the support frame coupled.

FIGS. 6A, 6B and FIG. 7 illustrate an example of an ink jet recording head wherein the discharge port member is closely in contact with the base board by the provision of a nailing unit for the discharge port member of the present invention. In this example, too, ink is discharged substantially in the surface direction of the elemental base board (the direction toward the surface of the elemental base board) as in the embodiment 1.

In this example, too, a heater board having elements for generating heat on its surface is used as a base board to create pressure for discharging ink by heating it rapidly by use of the elements for generating heat serving as those for generating discharge energy.

The elemental base board is made of a silicon wafer, and on its surface, the elements for generating heat are formed. The transistors, shift registers, and other driving circuit are incorporated on the base board for driving the elements for generating heat. The elements for generating heat are arranged at the end portion of the base board, and ink is supplied form the end portion of the base board.

As shown in FIG. 6A, the elemental base board is mounted on the supporting frame 14. For the discharge port member, the fine structure of discharge ports, nozzle portions, and others is formed. As shown in FIG. 6A, two extensions 8 and 8 are provided to sandwich the elemental base board. The principal part of an ink jet recording head is completed by combining the discharge port member and the elemental base board mounted on the supporting frame. FIG. 7 is a cross-sectional view of the recording head shown in FIGS. 6A and 6B, taken along the y-z plane. In the present embodiment, the discharge port member is fixed by the application of snap fastening. In other words, for the extensions of the discharge port member, there are provided a nail member 15 on the elemental base board side and a nail member 16 on the supporting frame side, and then, each of the nails are caused to hook on the elemental board and supporting frame, respectively, when assembled. Hence, by the elasticity of the nail members, the discharge port member is pulled to the base board side for fixation. In this way, by the utilization of the elasticity of the nailing portions, these members can function as biasing means for pulling the discharge port member without any provision of spring. Therefore, it is possible to constitute an ink jet recording head with a lesser number of parts.

In this respect, it is desirable to divide the nail member 15 on the base board side finely in order not to hinder the ink supply.

It is effective to adhesively bond the central part of the base board to the discharge port member by use of adhesives to enable the discharge port member and elemental base board to be in close contact reliably. Since there is no fine structure such as nozzles in the central part of the base board, the use of adhesives will not produce any adverse effect.

On the bottom of the supporting frame 14, a filter 17 is arranged. The principal part of this liquid jet head is assembled with an ink tank, and then, electrical components are assembled, thus completing the liquid jet head. In the present embodiment, the driving circuit being incorporated on the base board, it is possible to drive the head with a lesser number of wires to be arranged. Also, the elemental base board and a printed-circuit board can be connected by wire bonding on the surface of the base board at its end portion which is not covered by the discharge port member.

Embodiment 3

Figure 8:
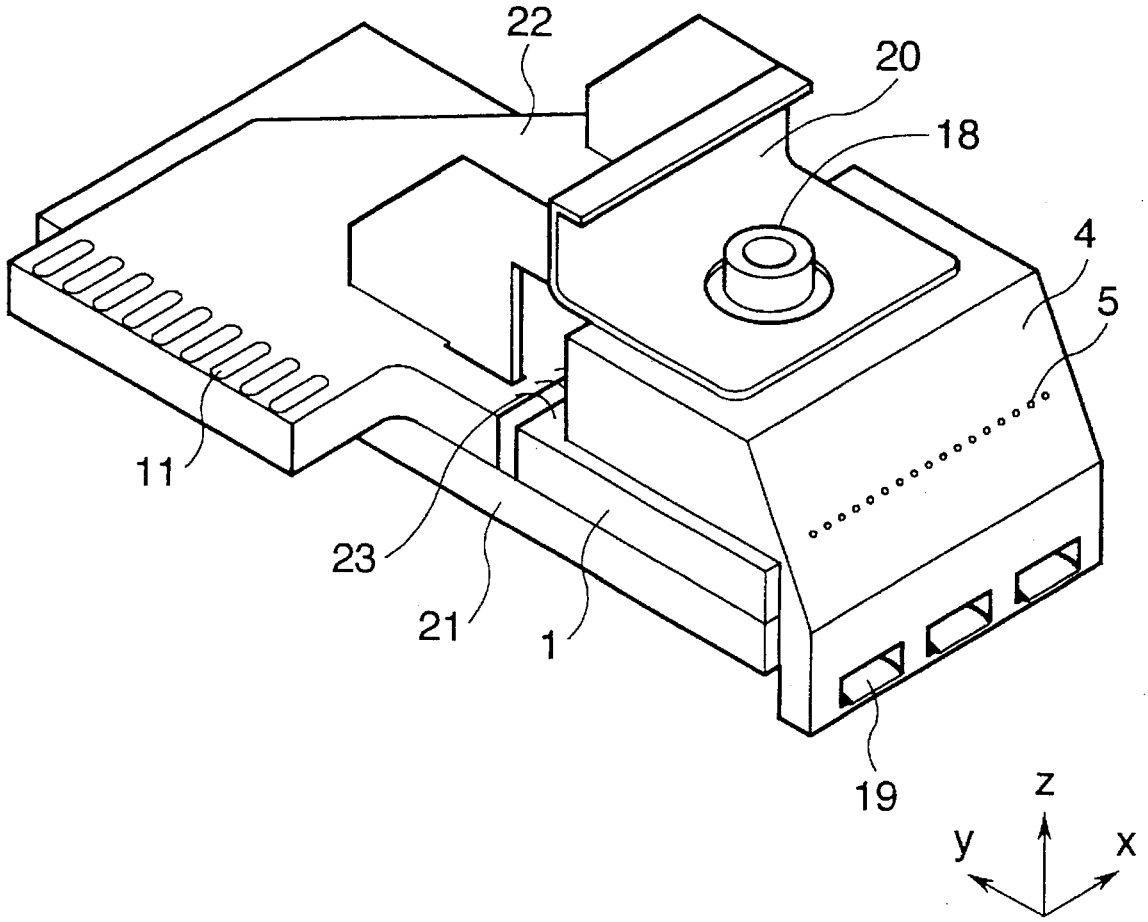
FIG. 8 is a perspective view which illustrates a liquid jet head according to the present invention.
Figure 9:
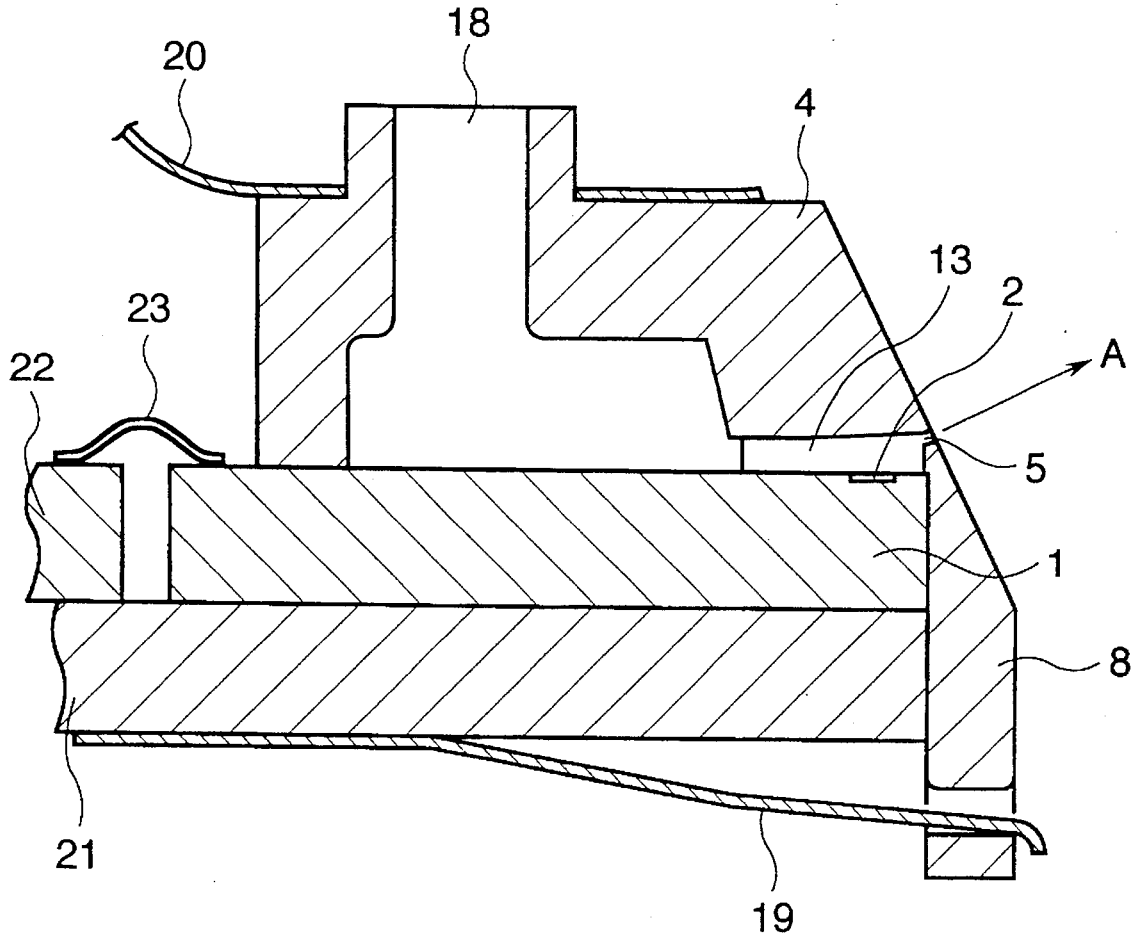
FIG. 9 is a cross-sectional view which illustrates the liquid jet head shown in FIG. 8, taken along the y-z plane.

FIG. 8 and FIG. 9 illustrate another example in which the ink discharging direction of a liquid jet head of the present invention is inclined with respect to the base board (substantially in the direction along the elemental base board). In this example, too, the heater board having elements for generating heat on its surface is used as the elemental base board as in the embodiment 1 and embodiment 2, but what differs is the direction in which ink is discharged along the base board. In FIG. 8, ink is supplied from the ink supply inlet 18 arranged on the discharge port member 4 to the nozzle unit near the end portion of the elemental base board, and discharged from the discharge ports 5.

Conventionally, in an ink jet recording head of the kind, it is necessary to press the discharge port member to the elemental base board from just above the discharge port member in order to place it in close contact with the elemental base board exactly. When the ink jet recording head should be arranged in a location close to a recording sheet, there is a problem that the spring unit abuts on the recording sheet if the head is arranged to discharge ink droplets in the direction substantially orthogonal to the recording sheet. In order to avoid this, it is necessary to make an arrangement so that the discharge is possible in the direction along the base board. This requirement results in a restriction when designing a liquid jet head. Also, even if the nozzle unit (liquid passage portion) can be pressed by a spring just from above the unit to effectuate its contact, the distributional center of the contacting force should be placed behind the nozzle unit inevitably. Here, therefore, a problem is encountered that the close contact between the nozzle unit and the elemental base board tends to be insufficient.

In the present embodiment, however, the front part of the discharge port member extends downward longer than the reverse side of the base board as shown in FIG. 9, and then, the extended part 8 is pulled down by means of a spring 19 on the lower side so that the discharge port member is pressed to be in close contact with the elemental base board. The upper side of the discharge port member is supplementarily compressed by an upper spring 20. Thus the entire body of the discharge port member is pressed to be in close contact with the elemental base board reliably.

In accordance with this example, the lower spring is divided into three parts as shown in FIG. 8, hence making it possible to press the entire unit having many numbers of nozzles to be in close contact with the elemental base board assuredly. If the width of the liquid jet head is small, there is no need for the sprint to be divided. If the width is greater still, it is preferable to divide the spring into more numbers.

It may be possible to fabricate the lower spring together with the extended portion of the discharge port member by the application of a resin formation. In such a case, it is unnecessary to divide the spring even when the width of the head is great.

As shown in FIG. 9, the elemental base board is mounted on a supporting member 21. On the supporting member 21, a printed-circuit board 22 is mounted in addition to it. The elemental base board and the printed-circuit board is connected by wire bonding 23. The liquid jet head is connected to the electric circuit on the printer main body through the contact points 11 on the printed-circuit board for its driving.

In accordance with the present embodiment, ink is discharged in the direction at an angle of approximately 30 degrees with respect to the base board. Therefore, the supporting member of the liquid jet head should only be mounted at an angle of 60 degrees with respect to the surface of a recording sheet. Thus ink can be discharged vertically to the recording sheet. When the liquid jet head is mounted on the apparatus main body in this way, both the upper and lower springs of the liquid jet head of the present embodiment do not extend beyond the position of the discharge ports toward the recording sheet side. As a result, the head can be arranged sufficiently close to the recording sheet, hence making it possible to perform a high-quality recording because there is no adverse effect to be produced, such as irregularity in discharging directions, disturbances caused by the air flow. In accordance with the present embodiment, the biasing force is generated by pulling the aforesaid extension from the reverse side of the elemental base board corresponding to the position of the liquid passage where the discharge port member should be pressed so that it is in close contact with the elemental base board most reliably. Because of this particular arrangement, it is possible to make the upper spring smaller, yet capable of pressing the discharge port member to be in close contact with the elemental base board still more reliably.

In the embodiments described above, the description has been made of the examples in which elements for generating heat are used as those for generating discharge energy, but it may be possible to use piezoelectric elements or the like as the elements for generating discharge energy, for example.

As a spring for pulling the discharge port member, it may be possible to use rubber, sponge, or some other elastic element besides a metallic spring or a resin spring. Also, for its configuration, the spring may be configured in a flat, coiled, blocked, or any other form arbitrarily.

Further, in accordance with the embodiments, grooved nozzles are formed on the discharge port member, and then, the nozzle unit is completed by pressing them to be in close contact with the base board, but it may be possible to fabricate the wall portions between the adjacent nozzles by some other methods. For example, using a dry film, the wall portions of the grooved nozzles are formed on a base board, and then, a discharge port member can be pressed to be in close contact therewith. Also, grooves may be formed in advance by means of etching or the like on the surface of the base board.

Also, in each of the embodiments described above, the discharging liquid is not necessarily limited to ink, but any other liquid may be used if only it is suitably applicable to a liquid jet head according to the present invention.

Embodiment 4

Figure 10:
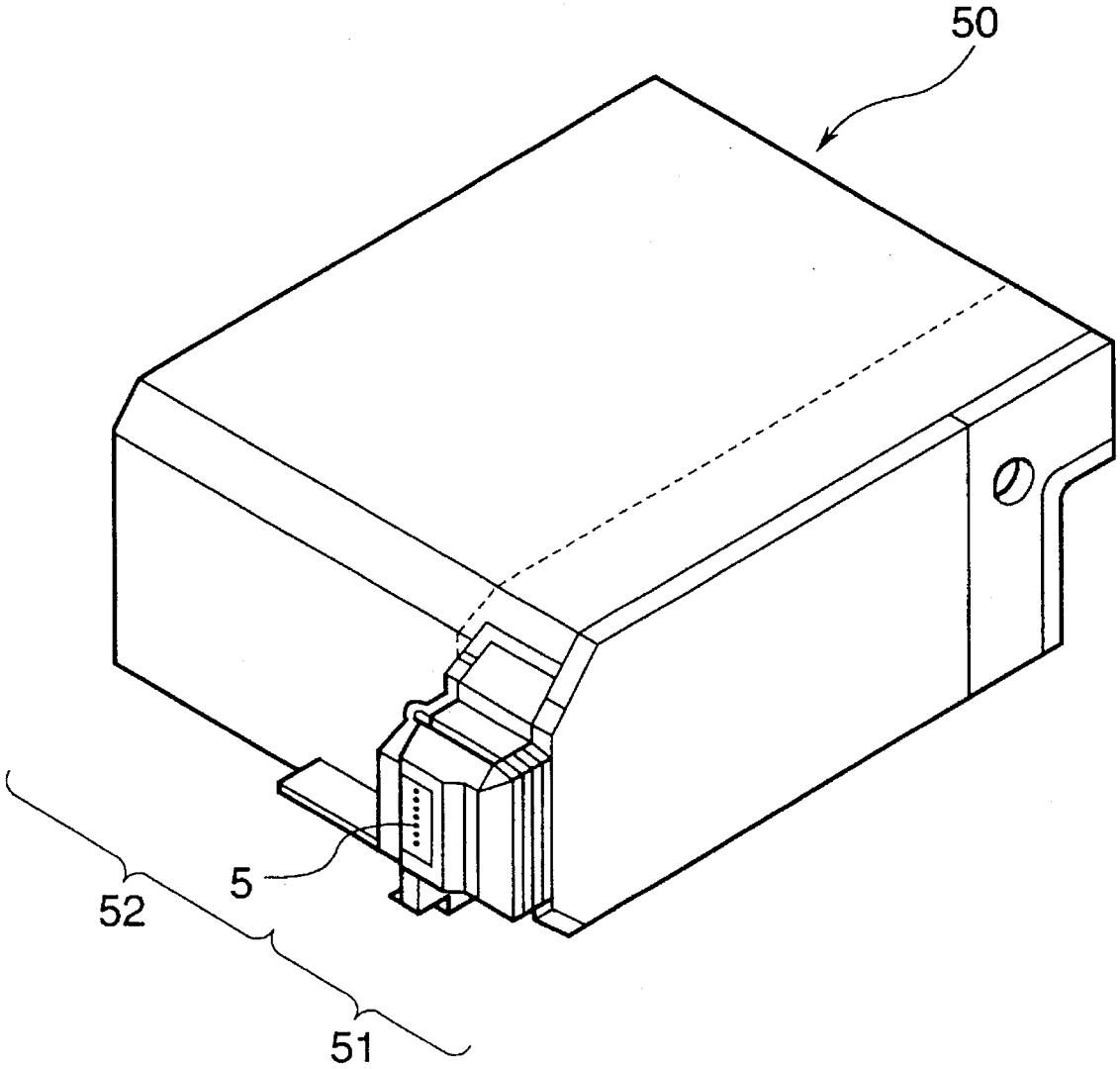
FIG. 10 is a view schematically showing a liquid jet head cartridge which uses a liquid jet head according to the present invention.

FIG. 10 is a view schematically showing a liquid jet head cartridge which uses a liquid jet head according to the present invention. The liquid jet head cartridge 50 is formed by connecting the liquid jet head 51 and a liquid container (ink container) 52 for retaining ink to be supplied to this head.

For this ink container, ink is refilled after it has been consumed.

Embodiment 5

Figure 11:
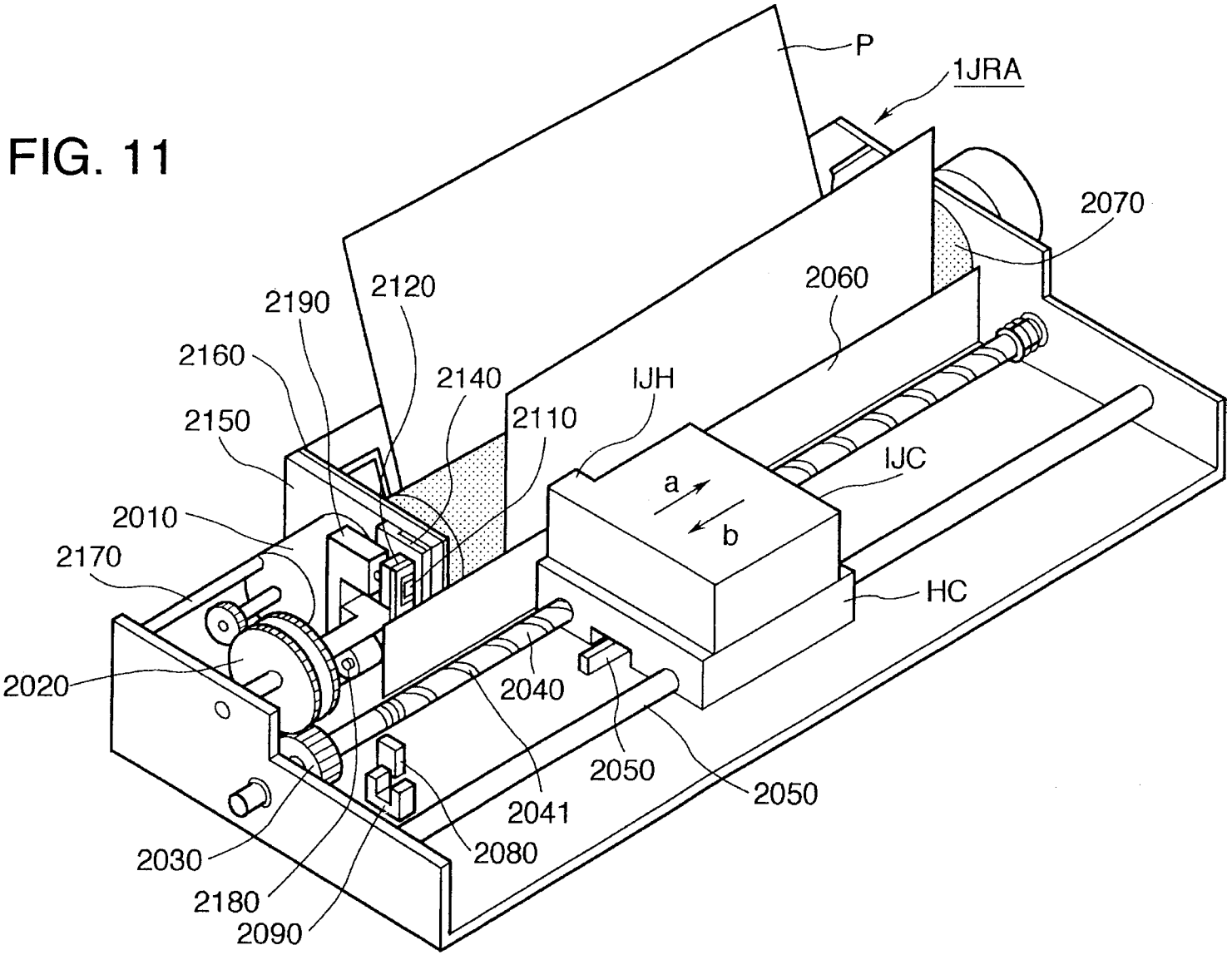
FIG. 11 is a view schematically showing a liquid jet apparatus which uses a liquid jet head according to the present invention.

FIG. 11 is a view showing an example of the external appearance of an ink jet recording apparatus having in it installed a liquid jet head (ink jet recording head) structured as described above. The ink jet recording apparatus IJRA is provided with a lead screw 2040 which is interlocked with the regular and reverse rotations of a driving motor 2010 to rotate through the driving force transmission gears 2020 and 2030. A carriage HC having an ink jet cartridge IJC formed integrally by an ink jet recording head and an ink tank is supported by the carriage shaft 2050 and the lead screw 2040. Provided with a pin (not shown) which fits in the spiral groove 2041 of the lead screw 2040, the carriage is caused to reciprocate in the directions indicated by arrows a and b following the rotations of the lead screw 2040. A reference numeral 2060 designates a sheet pressure board which compresses a sheet P in the traveling direction of the carriage with respect to a platen roller 2070 constituting means for feeding a recording medium; 2080 and 2090, a photocoupler operating as means for sensing the home position by detecting the lever 2100 which is arranged on the carriage HC in the area where the photocoupler is located in order to switch over the rotational direction of the motor 2010; 2110, a member for capping the entire surface of the recording head, which is supported by a supporting member 2120; 2130, means for absorbing contents in the interior of the cap to perform a suction recovery of the recording head through the aperture in the cap. A cleaning blade 2140 for cleaning the end face of the recording head is mounted on a member 2150 movably in the forward and backward directions. These are supported by a main body supporting board 2160. The blade 2140 is not necessarily limited to the mode described above. A known cleaning blade is of course applicable to the present embodiment. Also, a reference numeral 2170 designates a lever for recovering suction of the suction recovery, which is arranged to shift following the movement of a cam 2180 engaging with the carriage HC. In this way, the shifting of the driving force from the driving motor 2010 is controlled by a known transmission means such as switching over of a clutch.

These capping, cleaning, and suction recovery are arranged to perform the desired processes in the corresponding positions by the function of the lead screw 2040 when the carriage HC is brought into the area on the home position side. However, if only it is arranged to operate as desired at a known timing, any one of them is applicable to the present embodiment.

Also, an ink jet apparatus according the present invention is provided with means for supplying signals to the head for driving the element for generating discharge energy (elements for generating heat or the like) of the ink jet head of the present invention.

As set forth above, the description has been made of a case where two electrothermal transducing elements are adopted according to the present embodiment, but even when three or more eletrothermal transducing elements are adopted per nozzle, the relationship between the ratio of discharging rate and that of area by any one of these electrothermal transducing elements can of course satisfy the aforesaid relational expression.

As described above, in accordance with the present invention, the discharge port member can be pressed to be in close contact with the base board reliably with the arrangement of a simple structure. Consequently, even when many nozzles are provided in a high density, there is no possibility that pressure is caused to leak between the adjacent nozzles. Also, there is no need for applying adhesives or the like to the portions where a nozzle unit and other fine structures are arranged. Therefore, it is possible to fabricate a high-performance small ink jet recording head at a lower cost. Further, the distance between the discharge ports of the ink jet recording head and a recording medium can be made close enough in order to obtain a recorded image of a high quality.

What is claimed is:

1. A liquid jet head for recording by discharging a liquid from discharge ports including the following:

an elemental base board having on it elements for generating discharge energy to discharge a liquid;

a head having a discharge port member with a plurality of said discharge ports arranged therefor, constituting a plurality of liquid passages by being pressed to be in close contact with the surface of said elemental base board on the side where said elements for generating discharge energy are arranged, and said discharge port member having an extension extendedly present to the reverse side of said surface, and being provided with biasing means for pressing said discharge port member to be in close contact with said surface by exerting a biasing force on said extension.

2. A liquid jet head according to claim 1, wherein said biasing means is a nailing member provided for said extension.

3. A liquid jet head according to claim 1, wherein said biasing member is a spring.

4. A liquid jet head according to claim 1, wherein said extension is extendedly present to the reverse side of said surface through a hole or a cut-off portion provided for said elemental base board.

5. A liquid jet head according to claim 1, wherein said extension is provided with a through hole, and said biasing means is enabled to function through said through hole with respect to the discharge port member.

6. A liquid jet head according to claim 1, wherein said elements for generating discharge energy are elements for generating heat to create film boiling by giving heat to said liquid, and to discharge the liquid from said discharge ports by pressure exerted when air bubbles are generated.

7. A liquid jet head according to claim 1, wherein said elements for generating discharge energy are piezoelectric elements.

8. A liquid jet head according to claim 1, wherein said liquid is ink.

9. A liquid jet head according to claim 1, wherein said discharge ports are arranged substantially in the direction of said surface of said elemental base board.

10. A liquid jet head according to claim 1, wherein said discharge ports are arranged substantially in the direction along said elemental base board.

11. A liquid jet head cartridge for recording by discharging a liquid, comprising:

a liquid jet head according to claim 1; and a liquid container for retaining said liquid to be supplied to said liquid jet head.

12. A liquid jet head cartridge according to claim 11, wherein a liquid is filled in said liquid container.

13. A liquid jet head cartridge according to claim 11, wherein said biasing member is a spring.

14. A liquid jet head cartridge according to claim 11, wherein said extension is extendedly present to the reverse side of said surface through a hole or a cut-off portion provided for said elemental base board.

15. A liquid jet head cartridge according to claim 11, wherein said extension is provided with a through hole, and said biasing means is enabled to function through said through hole with respect to the discharge port member.

16. A liquid jet head cartridge according to claim 11, wherein said elements for generating discharge energy are elements for generating heat to create film boiling by giving heat to said liquid, and to discharge the liquid from said discharge ports by pressure exerted when air bubbles are generated.

17. A liquid jet head cartridge according to claim 11, wherein said elements for generating discharge energy are piezoelectric elements.

18. A liquid jet recording apparatus for recording by discharging a liquid, comprising:

a liquid jet head according to claim 1; and means for feeding a recording medium to feed a recording medium.

19. A liquid jet recording apparatus for recording by discharging a liquid, comprising:

a liquid jet head according to claim 1; and means for supplying driving signals to said recording head for driving it.

* * * * *

UNITED STATES PATENT AND TRADEMARK OFFICE

CERTIFICATE OF CORRECTION

PATENT NO. : 5,574,488

DATED : November 12, 1996

INVENTORS : YASUYUKI TAMURA

It is certified that error appears in the above-identified patent and that said Letters Patent is hereby corrected as shown below:

COLUMN 1

Line 18, "creation" should read --create--.

COLUMN 2

Line 19, "cross talks" should read --crosstalk--.

COLUMN 9

Line 26, "the" should read --to the--;
Line 62, "arranged," should read --arranged;--.

Signed and Sealed this

Eighth Day of April, 1997

*Attest:*

*Attesting Officer*

BRUCE LEHMAN

*Commissioner of Patents and Trademarks*